US006344095B1

(12) United States Patent
Kawabata et al.

(10) Patent No.: US 6,344,095 B1
(45) Date of Patent: Feb. 5, 2002

(54) LOW-THERMAL EXPANSION CAST STEEL WITH EXCELLENT MACHINABILITY

(75) Inventors: Masahide Kawabata, Fukuoka-ken; Toshihiro Uehara, Tottori-ken, both of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/612,560

(22) Filed: Jul. 7, 2000

(30) Foreign Application Priority Data

Jul. 8, 1999 (JP) ..... 11-193947
Apr. 6, 2000 (JP) ..... 2000-105071

(51) Int. Cl.[7] ..... C22C 38/00

(52) U.S. Cl. ..... 148/336; 148/442; 148/505; 420/94; 420/95

(58) Field of Search ..... 148/336, 333, 148/442, 505; 420/87, 94, 95, 97, 98

(56) References Cited

U.S. PATENT DOCUMENTS 4,832,908 A 5/1989 Ishikawa et al. ..... 420/95
4,904,447 A 2/1990 Handa ..... 420/95

FOREIGN PATENT DOCUMENTS

| | | | |
|---|---|---|---|
| EP | 468722 | * | 1/1992 |
| JP | 62040997 | * | 2/1987 |
| JP | 62284039 | * | 12/1987 |
| JP | 63162841 | * | 7/1988 |
| JP | 63162841 A | | 7/1988 |
| JP | 6093381 | * | 4/1994 |
| JP | 06172919 A | | 6/1994 |

OTHER PUBLICATIONS

Annual Book of ASTM standards vol. 01.02 (1985).

* cited by examiner

*Primary Examiner*—Sikyin Ip
(74) *Attorney, Agent, or Firm*—Sughrue Mion, PLLC

(57) ABSTRACT

A low-thermal expansion cast steel having an average linear thermal expansion coefficient of less than $4.0\times10^{-6}$/° C. in a range of room temperature to 100° C. and excellent machinability has a chemical composition (by mass) comprising 0.4–0.8% of C, 0.5% or less of Si, 1.0% or less of Mn, 0.01–0.3% of S, 30–40% of Ni, and 0.005–0.1% of Mg, the balance being substantially Fe and inevitable impurities, the contents of S and Mn satisfying $S \leqq (1/4)\ Mn$ or $(1/4)\ Mn < S \leqq (1/4)\ Mn + 0.05$.

14 Claims, No Drawings

LOW-THERMAL EXPANSION CAST STEEL WITH EXCELLENT MACHINABILITY

BACKGROUND OF THE INVENTION

The present invention relates to a low-thermal expansion cast steel having a high Ni content, more particularly to a low-thermal expansion cast steel having excellent machinability.

DESCRIPTION OF PRIOR ART

Recent development of industries in electronics and optics requires low-thermal expansion materials suffering from only small size variation due to thermal expansion and shrinkage by temperature changes near room temperature, for members constituting high-precision machine tools, high-precision measurement apparatuses, etc. To meet this demand, there have been an invar alloy of Fe—$Ni_{36}$ (by mass) having a linear thermal expansion coefficient of about $1.0\times10^{-6}$/° C. near room temperature, and a super invar alloy of Fe—$Ni_{32}$—$Co_5$ (by mass) having a linear thermal expansion coefficient of about $0.5\times10^{-6}$/° C. near room temperature.

However, the above Fe—Ni alloys and Fe—Ni—Co alloys are relatively soft, poor in machinability. Accordingly, in conventional cast products, graphite is crystallized or precipitated mainly in an austenitic matrix structure, such that graphite exhibits lubrication effects between cutting tools and the work made of low-thermal expansion materials, thereby achieving good machinability. Typical examples are cast steel ASTM A-436, TYPE 5 and A-439, TYPE D-5 containing carbon at a cast iron level (2% by mass or more) for the crystallization of graphite, and cast steel described in Japanese Patent Laid-Open No. 63-162841, in which the carbon content is increased to 0.8 weight % to precipitate graphite.

Among the above conventional low-thermal expansion materials, cast steel of ASTM A-439, TYPE D-5 has drastically improved machinability because of the precipitation or crystallization of a large amount of graphite as a machinability-improving component. However, it has as large an average linear thermal expansion coefficient as $4.0\times10^{-6}$/° C. or more in a range of 30–100° C. This is due to the fact that the cast steel has an increased level of micro-segregation of Ni serving to increase a thermal expansion coefficient because of the inclusion of about 2% by mass of C, and that the cast steel contains about 2% by mass of Si serving to increase a linear thermal expansion coefficient by $1.0\times10^{-6}$/° C. per 1% by mass. In members constituting apparatuses required to have higher precision such as semiconductor production apparatuses and semiconductor test apparatuses, an average linear thermal expansion coefficient of less than $4.0\times10^{-6}$/° C. is needed in a range of 30–100° C., making such low-thermal expansion cast iron as ASTM A-439, TYPE D-5 unsuitable therefor.

With respect to the cast steel disclosed by Japanese Patent Laid-Open No. 63-162841, it is suitable for members requiring high precision, because its average linear thermal expansion coefficient is $2.5\times10^{-6}$/° C. or less. However, it is much poorer in machinability than the cast iron of ASTM A-439, TYPE D-5, because the amount of graphite as a machinability-improving inclusion is only about ⅓ as compared with the cast iron of ASTM A-439, TYPE D-5.

OBJECT OF THE INVENTION

Accordingly, an object of the present invention is to provide a low-thermal expansion cast steel having a low thermal expansion coefficient and excellent machinability.

SUMMARY OF THE INVENTION

To have an average linear thermal expansion coefficient of less than $4.0\times10^{-6}$/° C. in a range of 30–100° C. and machinability not lower than that of the cast iron of ASTM A-439, TYPE D-5, the amounts of C and Si should be controlled to minimize increase in a thermal expansion coefficient, thereby increasing the amounts of machinability-improving inclusions. Here, there may be two or more types of machinability-improving inclusions. The machinability-improving inclusions may be MnS, MnSe, Pb, etc. in addition to the above graphite, though Se and Pb should be avoided because of strong toxicity, causing environmental contamination.

In view of this, the inventors have found that a low-thermal expansion cast steel having excellent machinability and a suppressed linear thermal expansion coefficient in a range of room temperature to 100° C. can be obtained by having an austenitic matrix structure in which both graphite and MnS having different functions to improve machinability are precipitated, and by minimizing the amount of elements dissolving in the matrix, which serve to increase a thermal expansion coefficient, thereby suppressing the micro-segregation of Ni. The present invention has been completed based on this finding.

Thus, the first low-thermal expansion cast steel with excellent machinability according to the present invention contains 0.3–0.9% by mass of C and 25–40% by mass of Ni, and having 0.5–3%, as an area ratio, of graphite and 0.02–0.3%, as an area ratio, of granular MnS in an austenitic matrix structure, whereby said cast steel has an average linear thermal expansion coefficient of less than $4.0\times10^{-6}$/° C. in a range of room temperature to 100° C.

The second low-thermal expansion cast steel with excellent machinability according to the present invention contains 0.3–0.9% by mass of C and 25–40% by mass of Ni, and having 0.5–3%, as an area ratio, of graphite, 0.02–0.3%, as an area ratio, of granular MnS, and 10–700, per 1 $mm^2$, of plate-like MnS having a length of 8 $\mu$m or more in an austenitic matrix structure, whereby said cast steel has an average linear thermal expansion coefficient of less than $4.0\times10^{-6}$/° C. in a range of room temperature to 100°.

In a preferred embodiment of the present invention, the low-thermal expansion cast steel with excellent machinability has a chemical composition (by mass) comprising 0.3–0.9% of C, 1.5% or less of Si, 1.0% or less of Mn, 0.01–0.3% of S, 25–40% of Ni, and 0.005–0.1% of Mg, the balance being substantially Fe and inevitable impurities, the contents of S and Mn satisfying $S \leqq (1/4)$ Mn.

In another preferred embodiment of the present invention, the low-thermal expansion cast steel with excellent machinability has a chemical composition (by mass) comprising 0.3–0.9% of C, 1.5% or less of Si, 1.0% or less of Mn, 0.01–0.3% of S, 25–40% of Ni, and 0.005–0.1% of Mg, the balance being substantially Fe and inevitable impurities, the contents of S and Mn satisfying $(1/4)\ Mn < S \leqq (1/4)\ Mn + 0.05$.

In a further preferred embodiment of the present invention, the low-thermal expansion cast steel with excellent machinability has a chemical composition (by mass) comprising 0.4–0.8% of C, 0.5% or less of Si, 1.0% or less of Mn, 0.01–0.3% of S, 30–40% of Ni, and 0.005–0.1% of Mg, the balance being substantially Fe and inevitable impurities, the contents of S and Mn satisfying $S \leqq (1/4)$ Mn.

In a still further preferred embodiment of the present invention, the low-thermal expansion cast steel with excellent machinability has a chemical composition (by mass) comprising 0.4–0.8% of C, 0.5% or less of Si, 1.0% or less of Mn, 0.01–0.3% of S, 30–40% of Ni, and 0.005–0.1% of Mg, the balance being substantially Fe and inevitable impurities, the contents of S and Mn satisfying (1/4) Mn<S≦(1/4) Mn+0.05.

The low-thermal expansion cast steel preferably contains 12% by mass or less, more preferably less than 4% by mass, of Co. It also preferably contains 4% by mass or less of Cr.

DETAILED DESCRIPTION OF THE PREFERRED EMBODIMENTS

[1] Composition of Low-thermal Expansion Cast Steel

The low-thermal expansion cast steel of the present invention contains at least 0.3–0.9% by mass of C and 25–40% by mass of Ni.

In a preferred embodiment, the chemical composition (by mass) of the low-thermal expansion cast steel is 0.3–0.9% of C, 1.5% or less of Si, 1.0% or less of Mn, 0.01–0.3% of S, 25–40% of Ni, and 0.005–0.1% of Mg, the balance being substantially Fe and inevitable impurities, the contents of S and Mn satisfying S≦(1/4) Mn.

In another preferred embodiment, the chemical composition (by mass) of the low-thermal expansion cast steel is 0.3–0.9% of C, 1.5% or less of Si, 1.0% or less of Mn, 0.01–0.3% of S, 25–40% of Ni, and 0.005–0.1% of Mg, the balance being substantially Fe and inevitable impurities, the contents of S and Mn satisfying (1/4) Mn<S≦(1/4) Mn+0.05.

(1) C

C has important functions of improving castability, suppressing the micro-segregation of Ni, and improving machinability by precipitation as graphite. To have enough castability, C should be 0.3% by mass or more. To precipitate graphite necessary for improving machinability, the carbon content should be 0.2% by mass or more. Also, to suppress the micro-segregation of Ni that increases a thermal expansion coefficient, the carbon content should be 0.3–0.9% by mass. Thus, the carbon content is 0.3–0.9% by mass. The preferred carbon content is 0.4–0.8% by mass.

(2) Si

Though Si is added to improve deoxidation and castability, the linear thermal expansion coefficient of the cast steel increases by about $1.0\times10^{-6}$/° C. per 1% by mass of Si. Also, too much Si hinders the castability because of increased difference between a solidification start temperature and a solidification finish temperature. Thus, the content of Si is 1.5% by mass or less, preferably 0.5% by mass or less.

(3) Mn

Mn is added not only for deoxidation, but also for forming MnS with S to improve the machinability of the cast steel. The linear thermal expansion coefficient of the cast steel increases by about $0.7\times10^{-6}$/° C. per 1% by mass of Mn. Thus, the content of Mn is 1.0% by mass or less, preferably 0.04–0.95% by mass, more preferably 0.3–0.95% by mass, most preferably 0.4–0.9% by mass.

(4) S

When S is added to an Fe—Ni—(Co) alloy containing Mn, a sulfide (MnS) with Mn is formed. MnS exists in two forms, one granular and the other plate-like. Granular MnS is formed in a range of S≦(1/4) Mn, and granular MnS and plate-like MnS are formed in a range of (1/4) Mn<S.

The granular MnS has a function of improving internal lubrication of work, resulting in decrease in shear stress necessary for generating chips, whereby cutting resistance exerted onto a cutting tool decreases. This serves to reduce the wear of a cutting tool.

The plate-like MnS has a notch function of concentrating stress, thereby generating micro cracks that propagate through the work, contributing to decrease in shear stress necessary for generating chips. As a result, cutting resistance exerted onto a cutting tool is reduced, thereby reducing the wear of a cutting tool. Further, the notch effect of plate-like MnS remarkably improves chip breakage.

To form granular MnS only, the contents of Mn and S should satisfy S≦(1/4) Mn. On the other hand, to form both granular MnS and plate-like MnS, the contents of Mn and S should satisfy (1/4) Mn<S≦(1/4) Mn+0.05. Because the effect of improving machinability can be obtained by the existence of both graphite and granular MnS, or the existence of graphite, granular MnS and plate-like MnS, the amount of S is determined to satisfy S≦(1/4)Mn or (1/4) Mn<S≦(1/4) Mn+0.05. Also, to improve machinability, S should be at least 0.01% by mass. An excess amount of S added lowers the solidification temperature in a finally solidified portion of the cast steel in a casting process, resulting in casting defects such as high-temperature cracking. Therefore, the range of S is 0.01–0.3% by mass, in addition to meeting the above equations.

When substantially only granular MnS is precipitated in an austenitic matrix structure, namely when S≦(1/4) Mn is satisfied, the content of S is preferably 0.01–0.1% by mass, more preferably 0.03–0.08% by mass, most preferably 0.04–0.07% by mass. On the other hand, when substantially both granular MnS and plate-like MnS are precipitated in an austenitic matrix structure, namely when (1/4) Mn<S≦(1/4) Mn+0.05 is satisfied, the content of S is preferably more than 0.1% by mass and 0.3% by mass or less, more preferably 0.11–0.25% by mass, most preferably 0.12–0.2% by mass.

(5) Ni

Ni is a main element contributing to increase in the thermal expansion coefficient of the cast steel. When an Fe—Ni alloy is solidified, negative micro-segregation, in which a Ni concentration is lower in dendrite cores than the average Ni concentration, usually occurs. The micro-segregation of Ni locally destroys component balance for obtaining low-thermal expansion characteristics, resulting in increase in a thermal expansion coefficient. Differing from the micro-segregation of an interstitial element such as C, the micro-segregation of a substitution-type element such as Ni cannot be eliminated without diffusion annealing at 1000° C. or higher for several tens of hours. Accordingly, to achieve a low thermal expansion coefficient under the heat treatment conditions of 800° C. or lower, the micro-segregation of Ni should be suppressed at the time of solidification. Micro-segregation is determined by a distribution coefficient, a ratio of a solid phase to a liquid phase at solidification. If the distribution coefficient is 1, no micro-segregation occurs. In general, the distribution coefficient of Fe—Ni alloys is about 0.8.

As a result of investigation, when the Ni content is in a range of 25–40% by mass, the distribution coefficient of Ni increases by the addition of C. At a carbon content of less than 0.3% by mass, the distribution coefficient of Ni is less than 1.0, resulting in negative micro-segregation. At a carbon content of 0.3–0.9% by mass, the distribution coefficient of Ni is almost 1.0, resulting in drastically reduced micro-segregation. When the carbon content exceeds 0.9% by mass, the distribution coefficient of Ni exceeds 1.0, resulting in positive micro-segregation, in which the Ni concentration is higher in dendrite cores than the average Ni concentration. Accordingly, the carbon content should be 0.3–0.9% by mass, to remarkably reduce the micro-segregation of Ni, thereby making it possible to keep the thermal expansion coefficient low only with graphitization annealing at 800° C. or lower. To precipitate graphite, a machinability-improving inclusion, by the graphitization annealing, the carbon content should be at least 0.2% by mass. In view of this, at the carbon content of 0.3–0.9% by mass, micro-segregation is drastically reduced, resulting in precipitation of graphite for improving machinability.

Therefore, to achieve an average linear thermal expansion coefficient of less than $4.0\times10^{-6}$/° C. in a range of room temperature to 100° C., the content of Ni is 25–40% by mass, preferably 30–40% by mass.

(6) Co

Co is a further element contributing to increase in the thermal expansion coefficient of the cast steel. Though the average linear thermal expansion coefficient is less than $4.0\times10^{-6}$/° C. in a range of room temperature to 100° C., the existence of 12% by mass or less of Co contributes to further decrease in the thermal expansion coefficient, thereby achieving an average linear thermal expansion coefficient of less than $4.0\times10^{-6}$/° C. more stably. Thus, the content of Co is 12% by mass or less, preferably 10% by mass or less, more preferably 9% by mass or less. Its lower limit is preferably 0.5% by mass, more preferably 1% by mass, most preferably 2% by mass. In some cases, it is less than 4% by mass.

(7) Mg

Because Mg forms MgS constituting nuclii for precipitating graphite, the content of Mg is at least 0.005% by mass. If it is contained improving too much, the crystallization and precipitation of MnS as an machinability-improving inclusion is hindered. Thus, the content of Mg should be 0.1% by mass or less.

(8) Cr

Cr is an element for increasing the thermal expansion coefficient of the cast steel without substantially changing the solidification start temperature and the solidification finish temperature. Thus, it can control the thermal expansion coefficient without deteriorating castability. If it is contained too much, different degrees of segregation of Cr occur in early-solidification portions and late-solidification portions, failing to stably control the thermal expansion coefficient of the cast steel. Thus, the Cr content is 4% by mass or less, preferably 3% by mass or less, further preferably 2.5% by mass or less. With respect to the lower limit of the Cr content, it is preferably 0.1% by mass to obtain sufficient effects thereof.

(9) Balance

The balance is substantially Fe and inevitable impurities. The amounts of inevitable impurities should be within generally accepted ranges.

[2] Structure

Because the cast steel of the present invention contains graphite and granular MnS, or graphite, granular MnS and plate-like MnS in an austenitic matrix structure, it exhibits excellent machinability with a low thermal expansion coefficient. Work made of such cast steel can be machined very easily in a reduced period of time.

(1) Graphite

In an as-cast state, the cast steel of the present invention does not contain graphite, though granular MnS or granular MnS+plate-like MnS are crystallized or precipitated in the matrix. To fully precipitate graphite for improving machinability in the matrix structure, annealing for graphitization at 550° C. or higher is necessary regardless of heating time. When the annealing temperature for graphitization is higher than 800° C., plate-like MnS dissolves in an austenitic matrix structure, and much smaller granular MnS than the originally crystallized granular MnS is precipitated again, resulting in drastic decrease in notch effect for improving machinability. Accordingly, to obtain both graphite and granular MnS (or granular MnS+plate-like MnS), an annealing temperature for graphitization of 550–800° C. is optimum. To maintain both graphite and granular MnS (or granular MnS+plate-like MnS) in the structure, any heat treatment other than the annealing temperature for graphitization conducted on the cast steel of the present invention should be 800° C. or lower.

Graphite lubricates work against a cutting tool, thereby suppressing damage on the cutting tool. The effect of improving machinability by graphite increases as the area ratio of graphite increases in the alloy structure. However, to suppress the micro-segregation of Ni, the content of C determining the amount of graphite precipitated should be 0.3–0.9% by mass. This range of carbon content provides the area ratio of graphite of 0.3–3%. Here, the area ratio of graphite is an average value determined on 50 fields of 0.2 mm×0.2 mm observed by a metal microscope.

(2) MnS

Granular MnS has a function of internal lubrication during a cutting operation, thereby reducing a cutting resistance and thus suppressing the damage of a cutting tool. To obtain full effects of improving machinability by the granular MnS, the granular MnS should be present in an area ratio of at least 0.02%. On the other hand, when the area ratio of the granular MnS exceeds 0.3%, the above effects are saturated. Therefore, the area ratio of the granular MnS is 0.02–0.3%. Here, the area ratio of the granular MnS is an average value determined on 50 fields of 0.2 mm×0.2 mm observed by a metal microscope. The granular MnS and graphite are easily appreciated by metal microscopic observation on a mirror-polished surface of the cast steel.

Plate-like MnS has a function of concentrating stress to exert notch effect, thereby generating micro cracks that propagate through the work, contributing to decrease in shear stress necessary for generating chips. As a result, cutting resistance exerted onto a cutting tool is reduced, thereby reducing the wear of a cutting tool. Further, the notch effect of plate-like MnS remarkably improves chip breakage.

The plate-like MnS appears like a rod or a needle in metal microscopic observation on a mirror-polished surface of the cast steel. Because MnS looking like a rod or a needle in a flat plane should be in the shape of a plate three-dimensionally, it is expressed as "plate-like MnS" here.

The number of plate-like MnS per 1 $mm^2$ is an average number determined on 50 fields of 0.2 mm×0.2 mm observed by a metal microscope.

If plate-like MnS is contained too much, the cast steel becomes brittle, tapping may cause various problems, such as chipping in screw threads of the work made of the low-thermal expansion cast steel. As a result of investigation, it has been found that when the number of plate-like MnS per 1 $mm^2$ exceeds 700, the above problems occur, and that when the number of plate-like MnS per 1 $mm^2$ is less than 10, or when plate-like MnS is as short as less than 8 $\mu$m, effects of improving machinability by plate-like MnS disappear. Thus, the number of plate-like MnS should be 10–700 per 1 $mm^2$, and plate-like MnS should be as long as 8 $\mu$m or more. To obtain plate-like MnS having a length of 8 $\mu$m or more in a number of 10–700 per 1 $mm^2$, Mn and S should be in a range of $(1/4)\,Mn<S\leqq(1/4)\,Mn+0.05$.

The present invention will be described in detail referring to EXAMPLES below without intention of limiting the present invention thereto.

EXAMPLES 1–7,

Comparative Examples 1–8

Each alloy having a chemical composition shown in Table 1 was melted in a 100-kg, high-frequency furnace. Each melt was poured into a sand mold (furan sand mold) at 1600° C. After solidification in the sand mold, a rectangular parallelepiped sample of 100 mm×100 mm×200 mm was taken out, and subjected to a heat treatment comprising keeping at 700° C. for 6 hours and air cooling.

The carbon content was smaller in a sample of COMPARATIVE EXAMPLE 1 and higher in a sample of COMPARATIVE EXAMPLE 2 than in those of EXAMPLES. The S content was smaller in a sample of COMPARATIVE EXAMPLE 3 and higher in a sample of COMPARATIVE EXAMPLE 4 than in those of EXAMPLES. The contents of C and S were smaller in a sample of COMPARATIVE EXAMPLE 5 than in those of EXAMPLES. The content of Cr was higher in a sample of COMPARATIVE EXAMPLE 6 than in those of EXAMPLES. Further, COMPARATIVE EXAMPLE 7 was ASTM A-439, TYPE D-5, a conventional cast-iron-type Fe—Ni alloy, and COMPARATIVE EXAMPLE 8 was the cast steel disclosed by Japanese Patent Laid-Open No. 63-162841.

TABLE 1

| | Chemical Component (mass %) | | | | | | | | |
|---|---|---|---|---|---|---|---|---|---|
| No. | C | Si | Mn | S | Ni | Co | Mg | Cr | Fe |
| Ex. 1 | 0.58 | 0.31 | 0.53 | 0.140 | 35.5 | — | 0.009 | — | Bal. |
| Ex. 2 | 0.58 | 1.10 | 0.53 | 0.161 | 37.5 | — | 0.008 | — | Bal. |
| Ex. 3 | 0.60 | 0.30 | 0.50 | 0.052 | 32.0 | 3.5 | 0.008 | — | Bal. |
| Ex. 4 | 0.61 | 0.29 | 0.51 | 0.133 | 28.0 | 8.4 | 0.010 | — | Bal. |
| Ex. 5 | 0.60 | 0.30 | 0.70 | 0.181 | 32.0 | 3.5 | 0.010 | — | Bal. |
| Ex. 6 | 0.59 | 0.30 | 0.52 | 0.142 | 31.8 | 3.6 | 0.005 | — | Bal. |
| Ex. 7 | 0.55 | 0.29 | 0.48 | 0.050 | 35.6 | — | 0.022 | 2.2 | Bal. |
| Com. Ex. 1 | 0.25 | 0.31 | 0.51 | 0.141 | 31.0 | 3.8 | 0.010 | — | Bal. |
| Com. Ex. 2 | 1.35 | 0.31 | 0.46 | 0.109 | 31.3 | 3.0 | 0.010 | — | Bal. |
| Com. Ex. 3 | 0.62 | 0.33 | 0.50 | 0.005 | 31.0 | 3.7 | 0.010 | — | Bal. |
| Com. Ex. 4 | 0.62 | 0.33 | 0.65 | 0.402 | 31.0 | 3.9 | 0.010 | — | Bal. |
| Com. Ex. 5 | 0.20 | 0.30 | 0.50 | 0.006 | 32.0 | 3.5 | 0.008 | — | Bal. |
| Com. Ex. 6 | 0.56 | 0.31 | 0.48 | 0.048 | 35.7 | — | 0.025 | 5.2 | Bal. |
| Com. Ex. 7 | 2.20 | 2.01 | 0.52 | 0.003 | 35.0 | — | 0.045 | — | Bal. |
| Com. Ex. 8 | 0.78 | 0.60 | 0.49 | 0.004 | 32.0 | 5.5 | 0.050 | — | Bal. |

Next, a test piece of 5 mm in diameter and 19.5 mm in length for thermal expansion coefficient measurement was cut out of each rectangular parallelepiped sample in a center portion thereof. After machining, a thermal expansion test was carried out to measure an average linear thermal expansion coefficient in a range of 30–100° C., according to a thermal expansion test method defined by JIS G 5511 "low-thermal expansion cast iron." Also, the microstructure of each sample was observed by a metal microscope. Table 2 shows the average linear thermal expansion coefficient in 30–100° C. and the microstructure of each sample.

TABLE 2

| | | Machinability-Improving Inclusions | | | |
|---|---|---|---|---|---|
| | $C_{av}$* | Graphite | Granular | Plate-Like MnS | |
| No. | ($\times 10^{-6}$/° C.) | Area ratio (%) | MnS Area ratio (%) | Length (μm) | Number (/mm$^2$) |
| Ex. 1 | 1.6 | 2.0 | 0.3 | 10 | 500 |
| Ex. 2 | 3.1 | 2.1 | 0.3 | 12 | 400 |

TABLE 2-continued

| | | Machinability-Improving Inclusions | | | |
|---|---|---|---|---|---|
| | $C_{av}$* | Graphite | Granular | Plate-Like MnS | |
| No. | ($\times 10^{-6}$/° C.) | Area ratio (%) | MnS Area ratio (%) | Length (μm) | Number (/mm$^2$) |
| Ex. 3 | 1.0 | 2.3 | 0.2 | — | — |
| Ex. 4 | 0.8 | 2.0 | 0.3 | 9 | 50 |
| Ex. 5 | 1.2 | 2.1 | 0.3 | 10 | 100 |
| Ex. 6 | 1.1 | 2.1 | 0.2 | 12 | 250 |
| Ex. 7 | 3.5 | 1.8 | 0.2 | — | — |
| Com. Ex. 1 | 1.0 | — | 0.4 | 10 | 200 |
| Com. Ex. 2 | 4.2 | 4.2 | 0.4 | — | — |
| Com. Ex. 3 | 1.1 | 2.1 | — | — | — |
| Com. Ex. 4 | 1.2 | 2.3 | 0.8 | 9 | 2000 |
| Com. Ex. 5 | 1.0 | — | — | — | — |
| Com. Ex. 6 | 6.0 | 1.8 | 0.2 | — | — |
| Com. Ex. 7 | 5.2 | 9.2 | — | — | — |
| Com. Ex. 8 | 0.9 | 2.2 | — | — | — |

Note *Average linear thermal expansion coefficient in 30–100° C.

A test piece for cutting test of 40 mm×40 mm×167 mm was cut out of each rectangular parallelepiped sample in a center portion thereof. After machining, machinability test was carried out with an end mill, a drill, a tap and a face mill under the conditions shown in Tables 3–6.

TABLE 3

| | | |
|---|---|---|
| Test tool: | End mill | High-speed cobalt steel |
| Test Conditions: | Cutting speed | 15 m/min. |
| | Feed | 0.10 mm/rev. |
| | Depth of cut | 0.1 × 5 mm |
| | Cutting direction | Down cut |
| | Lubrication | Wet |
| | Length of cutting | 20 m |

TABLE 4

| | | |
|---|---|---|
| Test tool: | Drill | High-speed cobalt steel of 4 mm in diameter |
| Test Conditions: | Cutting speed | 5 m/min. |
| | Feed | 0.05 mm/rev. |
| | Depth of drilling | 10 mm |
| | Number of drilled holes | 10 |
| | Lubrication | Wet |

TABLE 5

| | | |
|---|---|---|
| Test tool: | Tap | Sintered high-speed steel M3 |
| Test Conditions: | Cutting speed | 9 m/min. |
| | Depth of tapping | 7.5 mm |
| | Number of tapped holes | 20 |
| | Lubrication | Wet |

TABLE 6

| | | |
|---|---|---|
| Test tool: | Face mill | Cemented carbide chip 50 mm in diameter |
| Test Conditions: | Cutting speed | 60 m/min. |
| | Feed | 0.12 mm/rev. |
| | Depth of cut | 0.12 mm |
| | Cutting direction | Down cut/up cut |
| | Lubrication | Dry |
| | Length of cutting | 1 m |

The machinability was evaluated by the damage of a cutting tool and the conditions of chips. The damage of a cutting tool was expressed by the maximum wear of a cutting tool in the case of an end mill, the wear depth of an edge in the case of a drill, and the number of chipped threads in the case of a tap. The conditions of chips were determined by observing the color of chips and the state of broken chips in all of face-milling, end-milling, drilling and tapping. The results are shown in Table 7.

It is clear from the evaluation results of the damage of tools that the wear of a tool is extremely fewer in EXAMPLES 1–7 than in COMPARATIVE EXAMPLES 1–8 in the case of end-milling, drilling and tapping. Particularly in the cast steel of EXAMPLES 1, 2 and 4–6 containing plate-like MnS, long cutting is achieved with drastically improved chip breakage. Also, in the cast steel of EXAMPLE 3 containing no plate-like MnS, glossy chips were generated by face-milling. It is thus clear that the existence of both graphite and granular MnS improves the machinability of the cast steel, and that the existence of plate-like MnS in addition to graphite and granular MnS further improves the machinability of the cast steel.

COMPARATIVE EXAMPLE 7 was substantially the same level as that of the present invention, it was longer in chips and poorer in chip breakability than in the case of the present invention. Though the work of COMPARATIVE EXAMPLE 8 corresponding to Japanese Patent Laid-Open No. 63-162841 exhibited substantially the same machinability as that of the present invention in end-milling, drilling and tapping, chips generated from the work of COMPARATIVE EXAMPLE 8 were slightly brown in color in face-milling, indicating that it showed larger cutting resistance than the work of the present invention. Also, the work of COMPARATIVE EXAMPLE 8 was longer in chips and poorer in chip breakability than that of the present invention containing plate-like MnS in drilling and tapping.

TABLE 7

| | Damage of Tool | | | Conditions of Chips | | |
|---|---|---|---|---|---|---|
| | End Mill Maximum Wear | Drill Maximum Edge Wear | Tap Number of | Face Mill | Length (mm) of Chips | |
| No. | (mm) | (mm) | Chipped Threads | Color of Chip | Drill | Tap |
| Ex. 1 | 0.14 | 0.10 | 0 | Metal Gloss | 2–4 | 1–2 |
| Ex. 2 | 0.13 | 0.11 | 0 | Metal Gloss | 3–5 | 2–3 |
| Ex. 3 | 0.16 | 0.13 | 1 | Metal Gloss | ≧50 | ≧20 |
| Ex. 4 | 0.14 | 0.10 | 0 | Metal Gloss | 3–5 | 2–3 |
| Ex. 5 | 0.13 | 0.10 | 0 | Metal Gloss | 3–5 | 2–3 |
| Ex. 6 | 0.13 | 0.13 | 0 | Metal Gloss | 3–5 | 2–3 |
| Ex. 7 | 0.16 | 0.12 | 1 | Metal Gloss | ≧50 | ≧20 |
| Com. Ex. 1 | 0.27 | 0.23 | 10 | No Gloss(1) | 2–4 | 1–2 |
| Com. Ex. 2 | 0.14 | 0.13 | 0 | Metal Gloss | 3–5 | 3–5 |
| Com. Ex. 3 | 0.14 | 0.12 | 8 | No Gloss(1) | ≧50 | ≧20 |
| Com. Ex. 4 | 0.14 | 0.10 | 0(2) | Metal Gloss | ≦1 | ≦1 |
| Com. Ex. 5 | 0.35 | 0.28 | Broken(3) | No Gloss(4) | ≧50 | ≧20 |
| Com. Ex. 6 | 0.16 | 0.13 | 1 | Metal Gloss | ≧50 | ≧20 |
| Com. Ex. 7 | 0.13 | 0.10 | 0 | Metal Gloss | ≧50 | ≧20 |
| Com. Ex. 8 | 0.14 | 0.12 | 2 | No Gloss(1) | ≧50 | ≧20 |

Note:
(1)No gloss with slightly red brown.
(2)Chipping in threads of work.
(3)Tap was broken.
(4)No gloss with strong red brown.

On the other hand, in the cast steel of COMPARATIVE EXAMPLE 5 containing no machinability-improving inclusion in the austenitic matrix structure, good machinability was not achieved in the case of end-milling, drying, tapping and face-milling. In the cast steel of COMPARATIVE EXAMPLE 3 containing only graphite as a machinability-improving inclusion, machinability was poor in the case of tapping and face-milling. Further, the cast steel of COMPARATIVE EXAMPLE 1 containing only granular MnS and plate-like MnS as machinability-improving inclusions was poor in machinability in end-milling, drilling and face-milling. Though the cast steel of COMPARATIVE EXAMPLE 4 containing graphite and granular MnS together with a large amount of plate-like MnS exhibited good machinability, it suffered from chipping in threads of work in tapping.

Because the cast steel of COMPARATIVE EXAMPLE 7 corresponding to ASTM A-439, TYPE D-5 contained large amounts of C and Si, it showed as high an average linear thermal expansion coefficient as $5.2\times10^{-6}$/° C. in 30–100° C. Though the damage of a cutting tool caused by the work of As described above in detail, because one type of the low-thermal expansion cast steel of the present invention contains both graphite and granular MnS in its austenitic matrix structure, it shows good machinability. Further, another type of the low-thermal expansion cast steel of the present invention contains graphite, granular MnS and plate-like MnS in its austenitic matrix structure, it shows better machinability and chip breakability. Because the low-thermal expansion cast steel of the present invention can easily be machined in a short period of time.

What is claimed is:

1. A low-thermal expansion cast steel with excellent machinability consisting essentially of 0.3–0.9% by mass of Cg 25–40% by mass of Ni, 1.0% or less by mass of Mn, 0.01–0.3% by mass of S, 1.5% or less by mass of Si and 0.005–0.1% by mass of Mg, and having an area ratio of 0.03–3% of graphite and an area 0.002–0.3% of granular MnS in an austenitic matrix structure, whereby said cast steel has an average linear thermal expansion coefficient of less than $4.0\times10^{-6}$/° C. in a range of room temperature to 100° C.

2. A low-thermal expansion cast steel with excellent machinability consisting essentially of 0.3–0.9% by mass of C, 25–40% by mass of Ni, 1.0% or less by mass of Mn, 0.01–0.3% by mass of S, 1.5% or less by mass of Si and 0.005–0.1% by mass of Mg, and having an area ratio of 0.3–3% of graphite and an area ratio of 0.02–0.3% of granular MnS, and 10–700, per 1 $mm^2$, of plate-shaped MnS having a length of 8–12 $\mu$m in an austenitic matrix structure, whereby said cast steel has an average linear thermal expansion coefficient of less than $4.0\times10^{-6}$/° C. in a range of room temperature to 100° C.

3. A low-thermal expansion cast steel with excellent machinability having a chemical composition (by mass) consisting essentially of 0.3–0.9% of C, 1.5% or less of Si, 1.0% or less of Mn, 0.01–0.3% of S, 25–40% of Ni, and 0.005–0.1% of Mg, the balance Fe and inevitable impurities, the contents of S and Mn satisfying $S \leqq (1/4)$ Mn for precipitation of granular MnS in an austenitic matrix structure.

4. A low-thermal expansion cast steel with excellent machinability having a chemical composition (by mass) consisting essentially of 0.3–0.9% of C, 1.5% or less of Si, 1.0% or less of Mn, 0.01–0.3% of S, 25–40% of Ni, and 0.005–0.1% of Mg, the balance Fe and inevitable impurities, the contents of S and Mn satisfying $(1/4)\ Mn < S \leqq (1/4)\ Mn + 0.05$ for precipitation of granular MnS and plate-shaped MnS in an austenitic matrix structure.

5. The low-thermal expansion cast steel with excellent machinability according to claim 3, further containing 12% by mass or less of Co.

6. The low-thermal expansion cast steel with excellent machinability according to claim 4, further containing 12% by mass or less of Co.

7. The low-thermal expansion cast steel with excellent machinability according to claim 3, further containing 4% by mass or less of Cr.

8. The low-thermal expansion cast steel with excellent machinability according to claim 4, further containing 4% by mass or less of Cr.

9. A low-thermal expansion cast steel with excellent machinability having a chemical composition (by mass) consisting essentially of 0.4–0.8% of C, 0.5% or less of Si, 1.0% or less of Mn, 0.01–0.3% of S, 30–40% of Ni, and 0.005–0.1% of Mg, the balance Fe and inevitable impurities, the contents of S and Mn satisfying $S \leqq (1/4)$ Mn for precipitation of granular MnS in an austenitic matrix structure.

10. A low-thermal expansion cast steel with excellent machinability having a chemical composition (by mass) consisting essentially of 0.4–0.8% of C, 0.5% or less of Si, 1.0% or less of Mn, 0.01–0.3% of S, 30–40% of Ni, and 0.005–0.1% of Mg, the balance Fe and inevitable impurities, the contents of S and Mn satisfying $(1/4)\ Mn < S \leqq (1/4)\ Mn + 0.05$ for precipitation of granular MnS and plate-shaped MnS in an austenitic matrix structure.

11. The low-thermal expansion cast steel with excellent machinability according to claim 9, further containing less than 4% by mass of Co.

12. The low-thermal expansion cast steel with excellent machinability according to claim 10, further containing less than 4% by mass of Co.

13. The low-thermal expansion cast steel with excellent machinability according to claim 9, further containing 4% by mass or less of Cr.

14. The low-thermal expansion cast steel with excellent machinability according to claim 10, further containing 4% by mass or less of Cr.

* * * * *